US009095193B1

(12) United States Patent
Al-Hashemi et al.

(10) Patent No.: US 9,095,193 B1
(45) Date of Patent: Aug. 4, 2015

(54) WHEELED SUITCASE

(71) Applicants: Hanan Sherif Al-Hashemi, Andalus (KW); Seyed Ebrahim Esmaeili, Andalus (KW)

(72) Inventors: Hanan Sherif Al-Hashemi, Andalus (KW); Seyed Ebrahim Esmaeili, Andalus (KW)

( * ) Notice: Subject to any disclaimer, the term of this patent is extended or adjusted under 35 U.S.C. 154(b) by 0 days.

(21) Appl. No.: 14/557,375

(22) Filed: Dec. 1, 2014

(51) Int. Cl.
*A45C 5/14* (2006.01)

(52) U.S. Cl.
CPC ..... *A45C 5/146* (2013.01)

(58) Field of Classification Search
CPC ..... A45C 5/146
See application file for complete search history.

(56) References Cited

U.S. PATENT DOCUMENTS

| | | | | | |
|---|---|---|---|---|---|
| 1,471,766 | A * | 10/1923 | Wolfe | 248/96 |
| 5,568,848 | A | 10/1996 | Liang | |
| 5,873,439 | A | 2/1999 | Liang | |
| 5,984,326 | A * | 11/1999 | Abraham et al. | 280/47.2 |
| 6,164,425 | A * | 12/2000 | Latshaw | 190/18 A |
| 6,182,981 | B1 * | 2/2001 | Kuo | 280/37 |
| 6,345,414 | B1 * | 2/2002 | Chen | 16/113.1 |
| 6,497,311 | B2 | 12/2002 | Tiramani et al. | |
| 6,766,905 | B1 * | 7/2004 | Chang | 206/315.7 |
| 6,971,654 | B2 * | 12/2005 | Amsili | 280/47.2 |
| 7,226,073 | B1 | 6/2007 | Zahiri | |
| 7,303,070 | B1 * | 12/2007 | Hong | 206/315.6 |
| D587,904 | S | 3/2009 | Sherrell et al. | |
| 7,886,233 | B2 * | 2/2011 | Rainisto et al. | 715/773 |
| 8,020,678 | B2 | 9/2011 | Tsai et al. | |
| 2003/0168362 | A1 * | 9/2003 | Yoshida | 206/315.7 |
| 2004/0216970 | A1 | 11/2004 | Sherrell et al. | |
| 2008/0017463 | A1 | 1/2008 | Huang | |
| 2010/0163358 | A1 * | 7/2010 | Tsai et al. | 190/18 A |
| 2010/0175960 | A1 * | 7/2010 | Moskowitz et al. | 190/11 |

* cited by examiner

*Primary Examiner* — Tri Mai
(74) *Attorney, Agent, or Firm* — Richard C Litman

(57) ABSTRACT

The wheeled suitcase includes a storage compartment, a retractable handle extending from a top surface of the storage compartment, a pair of primary wheels extending from a bottom surface of the storage compartment, a panel pivotally attached to a lateral surface of the storage compartment at a first end, and an auxiliary wheel system pivotally secured to the lateral surface. The auxiliary wheel system includes a generally U-shaped frame, a fixed plate extending across the frame, and a pair of secondary wheels extending from a frame bottom. The fixed plate includes a plurality of grooves to releasably support a second end of the adjustable panel. The auxiliary wheel system can be secured in a plurality of adjustable positions to support the weight of the wheeled suitcase in varying inclined or tilted positions.

7 Claims, 4 Drawing Sheets

WHEELED SUITCASE

BACKGROUND OF THE INVENTION

1. Field of the Invention

The present invention relates to a wheeled suitcase that facilitates rolling movement on an underlying support surface, and particularly to a suitcase having a pivotal auxiliary wheel unit that permits rolling movement of the suitcase in a plurality of tilted orientations.

2. Description of the Related Art

Conventional suitcases are typically provided with a handle and one or more wheels extending from a bottom surface of the suitcase so that the suitcase can be rolled across a surface. A frequent problem encountered with rolling such suitcases is that the user must grip the handle and tilt the suitcase to an inclined position in order to roll the suitcase. When the suitcase is tilted in this manner, the weight of the case is at least partially supported by the user. The user can thereby be required to exert an appreciable amount of effort to support the case. Also, the user is required to raise the suitcase to an upright position to permit the suitcase to stand without support from a user.

Thus, a wheeled suitcase solving the aforementioned problems is desired.

SUMMARY OF THE INVENTION

The wheeled suitcase includes a storage compartment, a retractable handle extending from a top surface of the storage compartment, a pair of primary wheels extending from a bottom surface of the storage compartment, a panel pivotally attached to a lateral surface of the storage compartment at a first end, and an auxiliary wheel system pivotally secured to the lateral surface. The auxiliary wheel system includes a generally U-shaped frame, a fixed plate extending across the frame, and a pair of secondary wheels extending from a frame bottom. The fixed plate includes a plurality of grooves to releasably support a second end of the adjustable panel. The auxiliary wheel system can be secured in a plurality of adjustable positions to support the weight of the wheeled suitcase in varying inclined or tilted positions.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
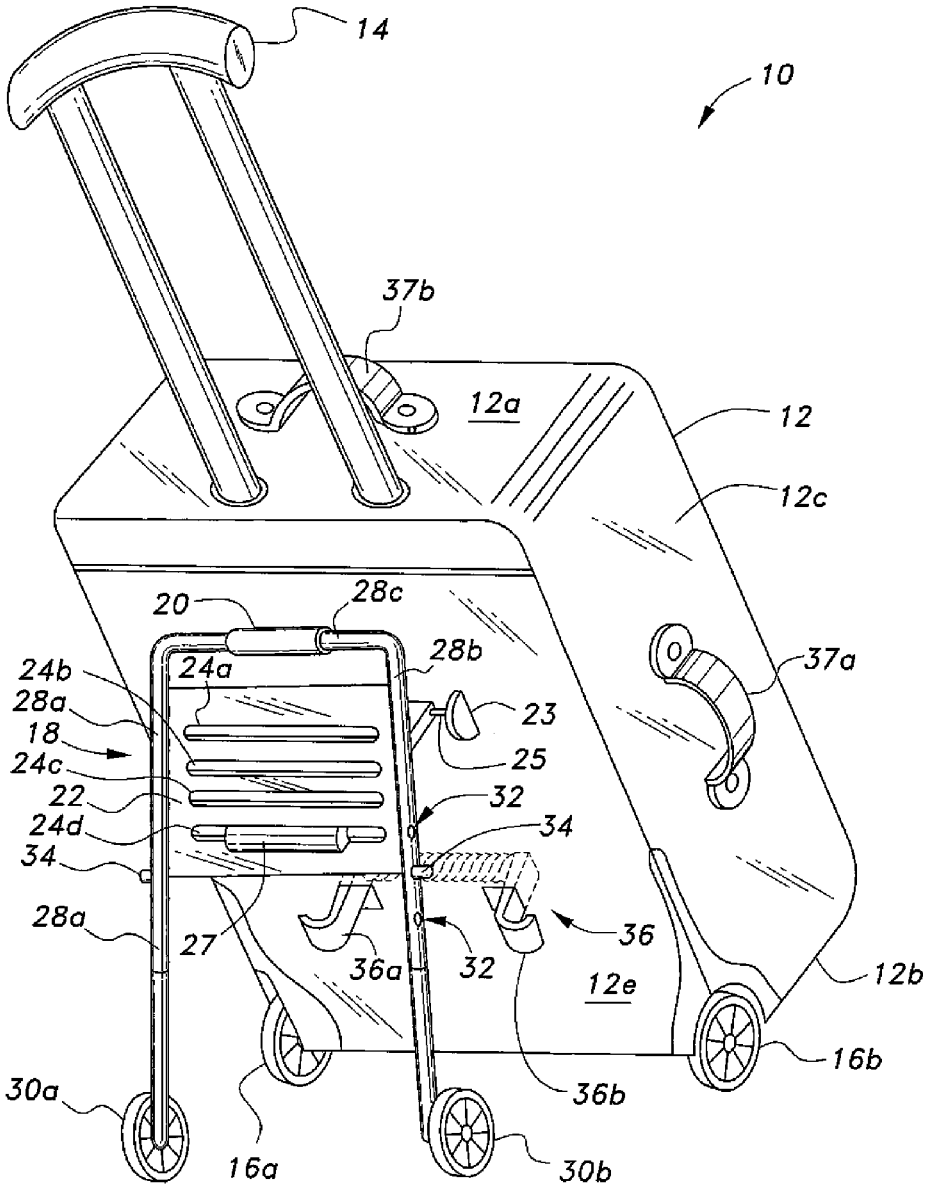
FIG. 1 is a perspective view of a wheeled suitcase according to the present invention.
Figure 2:
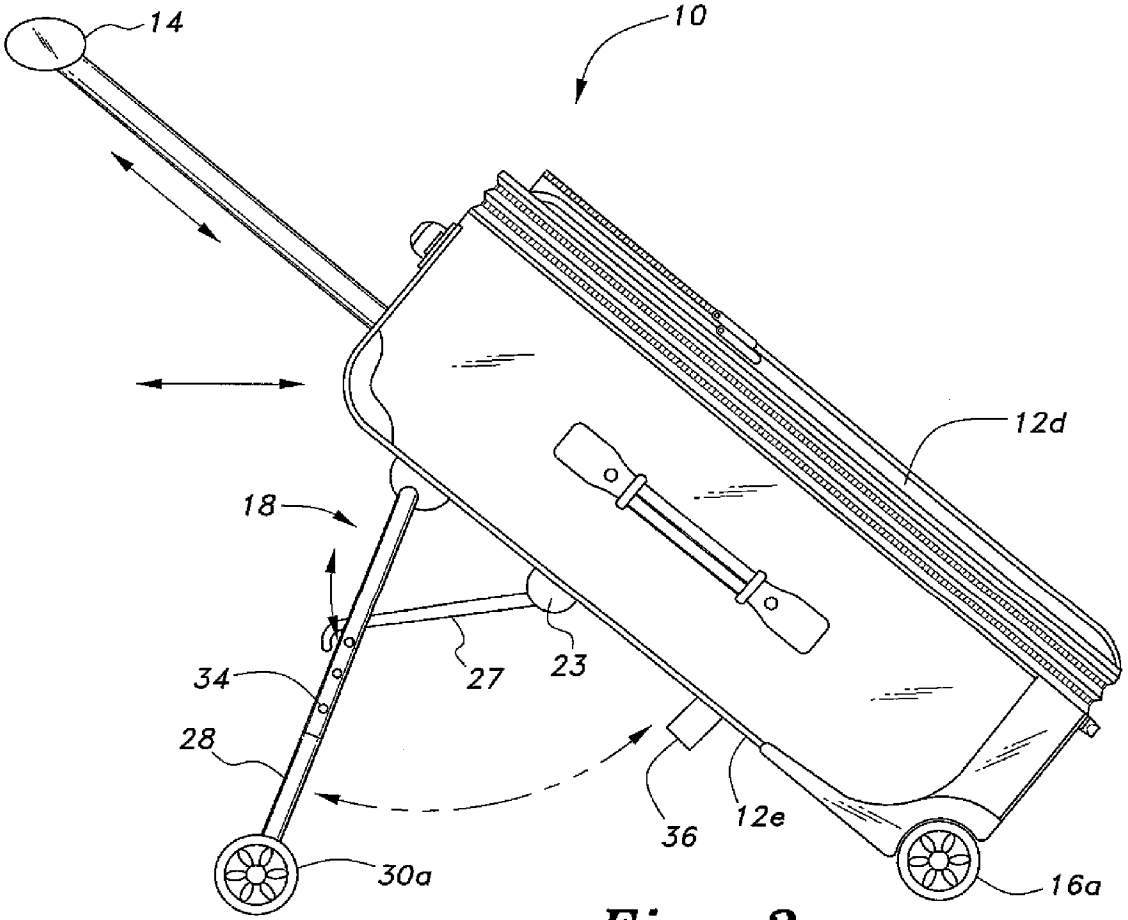
FIG. 2 is a side view of the wheeled suitcase of FIG. 1.
Figure 3:
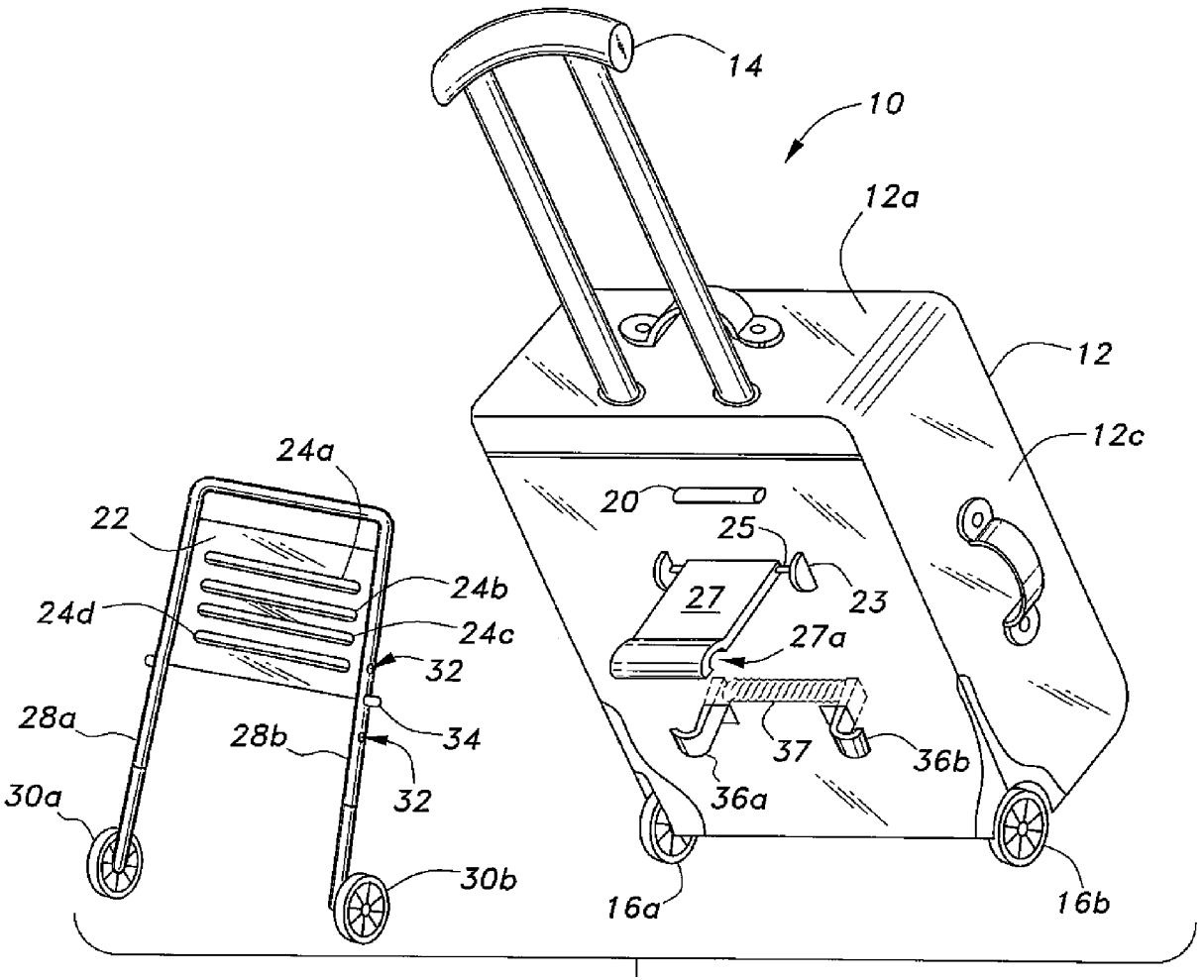
FIG. 3 is a partially exploded perspective view of the wheeled suitcase of FIG. 1.

Referring to FIGS. 1-4, the wheeled suitcase 10 has a storage compartment 12 having a top surface 12*a*, a bottom surface 12*b* opposite the top surface 12*a*, a pair of opposing side surfaces 12*c*, and first and second lateral surfaces 12*d* and 12*e*. The wheeled suitcase 10 further includes a retractable handle 14, a pair of primary wheels 16*a* and 16*b*, and an auxiliary wheel system 18 pivotally secured to the second lateral surface 12*e* by a pivotal connector 20. The auxiliary wheel system 18 can include a generally U-shaped frame 28 and a pair of secondary wheels 30*a* and 30*b* attached to the frame 28.

The frame 28 includes a first telescoping member 28*a*, a second telescoping member 28*b*, and a cross-member 28*c* that extends between and connects the telescoping members 28*a* and 28*b*. The telescoping members 28*a* and 28*b* and the cross-member 28*c* may be tubular, e.g., have a hollow interior. The cross-member 28*c* is pivotally attached to the suitcase 10 by the connector 20. The connector 20 has a hollow tube through which at least a portion of cross-member 28*c* can extend. The cross-member 28*c* can be pivotal with respect to the connector 20. While a generally narrow U-shaped frame 28 is shown in the drawings, it should be understood that the frame 28 can be configured to achieve any suitable width. For example, the frame 28 can have a width that is the same as, or about the same as, the width of the suitcase to provide increased stability.

Each of the telescoping members 28*a* and 28*b* can be extended or retracted to adjust the height of the frame and/or tilt angle of the suitcase 10. Each telescoping member 28*a* and 28*b* has an upper fixed portion or sleeve and a lower extension or movable portion. The movable portions can be slidably positioned within the fixed portions in any suitable manner. For example, fixed portions of the telescoping members 28*a* and 28*b* can include a plurality of apertures 32 at predetermined, vertically spaced positions thereof. Apertures 32 of the telescoping member 28*a* can be in alignment with the plurality of apertures 32 defined in the telescoping member 28*b*. Lower portions of the telescoping members 28*a* and 28*b* can include pins 34, e.g., spring-loaded pins, which are positioned and configured for slidable insertion into the apertures 32. The pins 34 can be removably inserted into apertures 32 defined in the telescoping members 28*a* and 28*b* to adjust the height of the frame. Wheels 30*a* and 30*b* extend from a bottom end of the telescoping members 28*a* and 28*b*.

The wheeled suitcase 10 can include an adjustable panel 27 that is pivotally attached to the lateral surface 12*e* of the suitcase 10. A rod 25 and a pair of brackets 23 connected to opposing ends of the rod are fixed to the lateral surface 12*e* of the suitcase 10. A first end of the adjustable panel 27 is configured to receive and pivotally engage the rod 25 therethrough. A fixed plate 22 is provided within the frame 28 for supporting a second end of the panel 27. The plate 22 can include a series of slots or grooves 24*a*, 24*b*, 24*c*, and 24*d* for receiving the second end of the panel 27. The panel 27 can include a second end 27*a* that is curved or hook-shaped to prevent unintentional release of the panel 27 from the slots 24*a*, 24*b*, 24*c*, and 24*d*, as shown more clearly in FIG. 3. The height and/or tilt angle of the wheeled suitcase 10 can be adjusted by insertion of the panel 27 in the appropriate grooves 24*a*, 24*b*, and 24*c*, as desired.

The retractable handle 14 includes two legs and a gripping member extending therebetween. The handle can be retractable into and extendable out of the volume of the suitcase. To enable retraction and extension, the handle can include an extension portion and a carrier supported by the suitcase. The handle can include a locking mechanism for locking the handle in the retracted and one or more extended positions. The handle can be employed by a user to effect rolling movement of the suitcase across an underlying support surface.

The wheeled suitcase 10 may have one or more carry handles 37*a* and 37*b* mounted on one or more surfaces thereof. The carry handles 37*a* and 37*b* can be employed by the user to grasp the suitcase 10 and lift it, thereby supporting the entire weight thereof.

A latch mechanism 36 is provided on the lateral surface 12*e* of the suitcase 10 for securing the frame 28 to the suitcase 10 when the auxiliary wheel system 18 is folded or in a stowed position. As shown more clearly in FIG. 3, the latch mechanism 36 includes a pair of spring-loaded latches, 36*a* and 36*b*, and a spring 37 disposed between the latches 36*a* and 36*b*. The spring-loaded latches 36*a* and 36*b* can slide toward each other when a user presses against one or both of the latches 36*a* and 36*b*.

Figure 4:
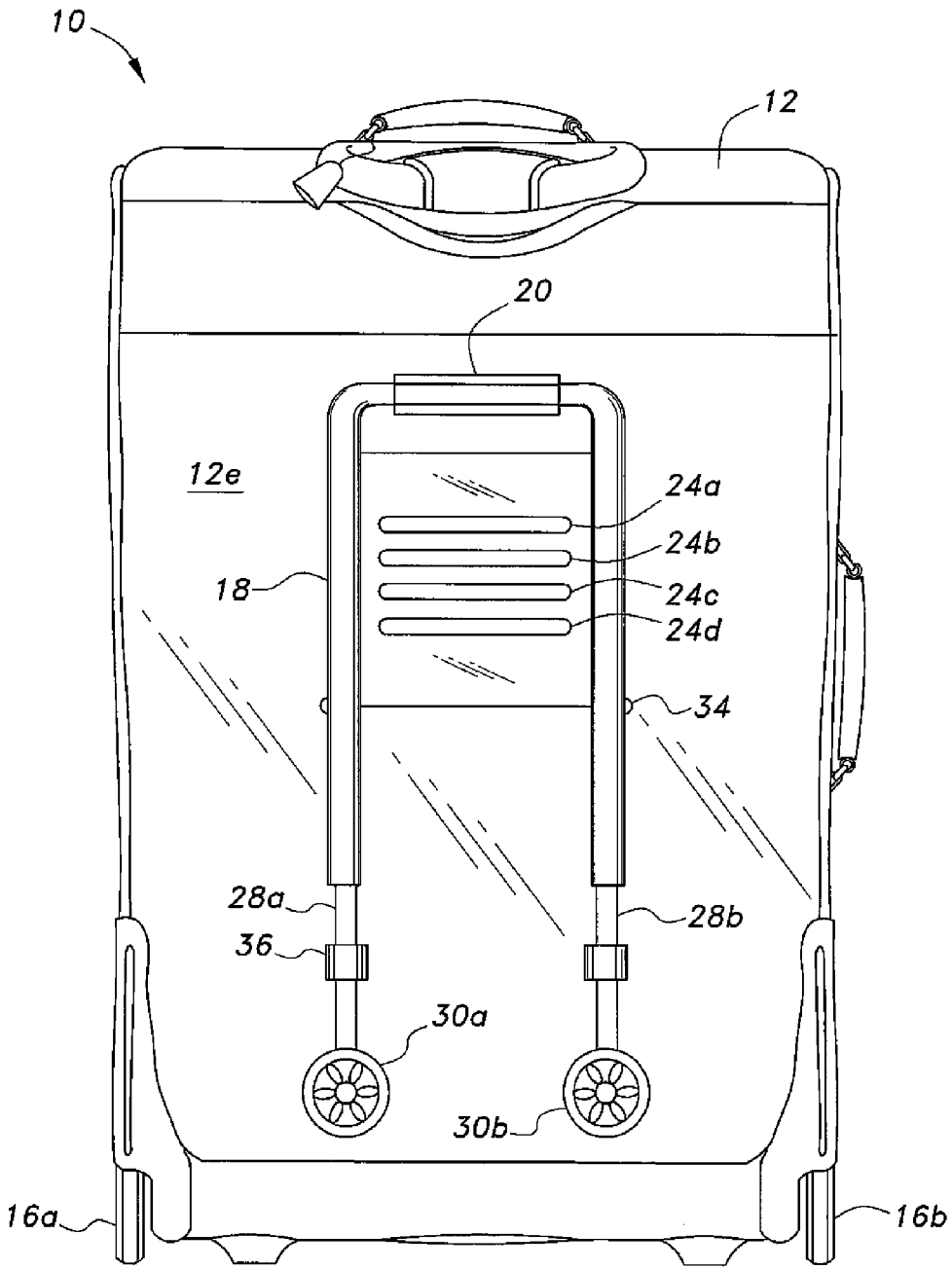
FIG. 4 is a rear view of the wheeled suitcase of FIG. 1.

When a user desires to stow the auxiliary wheel system 18, the telescoping members 28*a* and 28*b* can be retracted to shorten the length of the members 28*a* and 28*b*. The telescoping members 28*a* and 28*b* can then be folded inward and pushed against the latches 36*a* and 36*b*. The pressure exerted on the latches 36*a* and 36*b* will cause the latches 36*a* and 36*b* to move inward, e.g., toward each other, and thereby allow the members 28*a* and 28*b* to pass beyond the latches 36*a* and 36*b* and press against the lateral surface 12*e*. Once the telescoping members 28*a* and 28*b* are in contact with the lateral surface 12*e*, the latches 36*a* and 36*b* move outward, e.g., away from each other, to hold or engage the respective telescoping members 28*a* and 28*b* of the frame in a stowed position, as shown in FIG. 4.

It is to be understood that the present invention is not limited to the embodiments described above, but encompasses any and all embodiments within the scope of the following claims.

We claim:

1. A wheeled suitcase, comprising:

a storage compartment having a top surface, a bottom surface, a pair of opposing side surfaces, and first and second lateral surfaces;

a retractable handle extending from the top surface of the storage compartment;

a pair of primary wheels extending from the bottom surface of the storage compartment;

an adjustable panel having first and second ends, the adjustable panel being pivotally attached to the first lateral surface of the storage compartment at the first end; and an auxiliary wheel system including:

a frame pivotally attached to the first lateral surface of the storage compartment, the frame having a bottom end;

a fixed plate extending across the frame, the fixed plate including a plurality of grooves wherein each groove is configured to releasably engage the second end of the adjustable panel; and a plurality of secondary wheels extending from the bottom end of the frame, the second end of the adjustable panel selectively engaging the fixed plate at the plurality of grooves.

2. The wheeled suitcase according to claim 1, wherein the frame is substantially U-shaped and includes a first telescoping member, a second telescoping member spaced from the first telescoping member, and a cross-member extending between and connecting the first and second telescoping members.

3. The wheeled suitcase according to claim 2, wherein the first and second telescoping members each include an upper fixed portion and a lower extension portion, the lower extension portion of each of the first and second telescoping members being configured to extend out of and retract into a respective one of the fixed upper portions.

4. The wheeled suitcase according to claim 3, wherein the upper fixed portions of the telescoping members include a plurality of apertures defined therein, and the lower extension portions include pins, the pins being slidably insertable into the plurality of apertures.

5. The wheeled suitcase according to claim 1, further comprising:

a pair of brackets extending from the first lateral surface; and a rod extending between the brackets and through the first end of the adjustable panel, the adjustable panel pivotally engaging the rod.

6. The wheeled suitcase according to claim 1, further comprising a tubular connector on the first lateral surface, at least a portion of the cross-member extending through and pivotally engaging the tubular connector.

7. The wheeled suitcase according to claim 1, further comprising a pair of spring-loaded latches disposed on the first lateral surface, the latches being configured to engage the telescoping members when the auxiliary wheel system is in a stowed position.

* * * * *